US011802527B2

(12) United States Patent
Onkarachari et al.

(10) Patent No.: US 11,802,527 B2
(45) Date of Patent: Oct. 31, 2023

(54) GASOLINE EGR COOLER WITH IMPROVED THERMO-MECHANICAL FATIGUE LIFE

(71) Applicant: Hanon Systems, Daejeon (KR)

(72) Inventors: Sunil Kumar Harihar Onkarachari, Karnataka (IN); Steven C. White, Pinckney, MI (US); Dale Martin Pickelman, Jr., Holland, MI (US)

(73) Assignee: HANON SYSTEMS, Daejeon (KR)

( * ) Notice: Subject to any disclaimer, the term of this patent is extended or adjusted under 35 U.S.C. 154(b) by 231 days.

(21) Appl. No.: 16/823,472

(22) Filed: Mar. 19, 2020

(65) Prior Publication Data

US 2020/0309071 A1 Oct. 1, 2020

Related U.S. Application Data

(60) Provisional application No. 62/827,328, filed on Apr. 1, 2019.

(51) Int. Cl.
*F02M 26/73* (2016.01)
*F02B 29/04* (2006.01)

(52) U.S. Cl.
CPC ..... *F02M 26/73* (2016.02); *F02B 29/045* (2013.01); *F02B 29/0443* (2013.01)

(58) Field of Classification Search
CPC .... F02M 26/73; F02M 26/32; F02B 29/0443; F02B 29/045
USPC ..... 123/568.12
See application file for complete search history.

(56) References Cited

U.S. PATENT DOCUMENTS

2009/0314483 A1* 12/2009 Kalbacher ..... F02B 29/0456 165/185
2016/0146162 A1* 5/2016 Janke ..... F02M 26/28 165/174

* cited by examiner

*Primary Examiner* — Lindsay M Low
*Assistant Examiner* — Omar Morales
(74) *Attorney, Agent, or Firm* — Shumaker, Loop & Kendrick, LLP; James D. Miller

(57) ABSTRACT

A heat exchanger includes a housing having a heat exchanger core and a precooling flow structure disposed therein. The heat exchanger core is configured for exchanging heat between a first fluid and a second fluid. The precooling flow structure is coupled to each of the housing and an inlet end of the heat exchanger core with respect to a flow of the first fluid. An interior of the precooling flow structure is configured to convey the first fluid therethrough, The precooling flow structure includes at least one precooling tube extending through the interior of the precooling flow structure with each of the at least one precooling tubes configured to convey the second fluid therethrough in order to precool the first fluid before the first fluid enters the inlet end of the heat exchanger core.

14 Claims, 4 Drawing Sheets

GASOLINE EGR COOLER WITH IMPROVED THERMO-MECHANICAL FATIGUE LIFE

CROSS-REFERENCE TO RELATED APPLICATION

This patent application claims priority to U.S. Provisional Patent Application Ser. No. 62/827,328, filed on Apr. 1, 2019, the entire disclosure of which is hereby incorporated herein by reference.

TECHNICAL FIELD

The invention concerns a heat exchanger for exhaust gas cooling in motor vehicles, and more specifically, a precooling flow structure of the heat exchanger having laterally extending heat exchanger tubes disposed within an inlet region of the heat exchanger.

BACKGROUND

Systems for exhaust gas recirculation in motor vehicles are known from the prior art, with which the nitrogen oxides in the exhaust gases of motor vehicles are reduced and the fuel consumption of gasoline-operated motor vehicles is decreased. In the exhaust gas recirculation systems of this kind, cooled or noncooled exhaust gas is mixed in with the fresh air taken in by the engine.

During combustion at high temperatures, environmentally harmful nitrogen oxides are produced in the engine of motor vehicles. In order to decrease the emission of nitrogen oxides, a lowering of the high temperature peaks and a decreasing of the excess air during combustion is necessary. Thanks to the lower oxygen concentration of the fuel and air mixture, a rate of the combustion process and thus, the maximum combustion temperatures are reduced. Both effects are accomplished by mixing in a partial flow of exhaust gas in the fresh air flow taken in by the engine.

However, the mixing in of the recirculated exhaust gas flow with high temperatures reduces the cooling effect of the exhaust gas recirculation on the combustion. Furthermore, a mixture of air and exhaust with high temperatures that is aspirated by the engine has negative impact on the cylinder filling and thus, on the power density of the engine. In order to counteract the negative effects, prior to the mixing the exhaust gas is cooled down in a heat exchanger, the so-called exhaust gas heat exchanger or exhaust gas recirculation (EGR) cooler.

The exhaust gases entering the EGR cooler generally include a relatively high temperature (such as 950° C.). These relatively high temperatures tend to cause the internal parts of the EGR cooler to develop high localized thermal stress and strain amplitudes within an inlet region of the EGR cooler as a result of the varying thermal expansion of the EGR cooler. These effects may, for example, be experienced within an inlet region of a heat exchanging portion of the EGR cooler, wherein the exhaust gases and a corresponding coolant circulated by the EGR cooler are first caused to exchange heat with each other. A cycling of these localized high thermal stress and strain amplitudes leads to the EGR cooler undergoing excessive thermo-mechanical fatigue. The EGR cooler is accordingly subject to fail following an undesirably low number of thermal cycles.

It would accordingly be desirable to produce an EGR cooler having a precooling feature suitable for eliminating the undesirably high thermal stress and strain amplitudes within the EGR cooler by pre-cooling the exhaust gases when first entering the corresponding EGR cooler.

SUMMARY OF THE INVENTION

Consonant with the present disclosure, a heat exchanger including a precooling feature for cooling the exhaust gases within an inlet region of the heat exchanger has surprisingly been discovered.

According to one embodiment of the present invention, a heat exchanger includes a heat exchanger core configured for exchanging heat between a first fluid and a second fluid and a precooling flow structure coupled to an inlet end of the heat exchanger core with respect to a flow of the first fluid. An interior of the precooling flow structure is configured to convey the first fluid therethrough. The precooling flow structure includes at least one precooling tube extending through the interior of the precooling flow structure. Each of the at least one precooling tubes is configured to convey the second fluid therethrough in order to precool the first fluid before the first fluid enters the inlet end of the heat exchanger core.

According to another embodiment of the present invention, a heat exchanger includes a housing having a heat exchanger core and a precooling flow structure disposed therein. The heat exchanger core is configured for exchanging heat between a first fluid and a second fluid. The precooling flow structure is coupled to each of the housing and an inlet end of the heat exchanger core with respect to a flow of the first fluid, and an interior of the precooling flow structure is configured to convey the first fluid therethrough. The precooling flow structure includes at least one precooling tube extending through the interior of the precooling flow structure with each of the at least one precooling tubes configured to convey the second fluid therethrough in order to precool the first fluid before the first fluid enters the inlet end of the heat exchanger core.

DESCRIPTION OF THE DRAWINGS

Further details, features and advantages of the invention will emerge from the following specification of sample embodiments making reference to the accompanying drawings.

DETAILED DESCRIPTION

The following detailed description and appended drawings describe and illustrate various exemplary embodiments of the invention. The description and drawings serve to enable one skilled in the art to make and use the invention, and are not intended to limit the scope of the invention in any manner.

As used herein, references to direct fluid communication between two fluid conveying structures indicates that the fluid passes directly from a first fluid conveying structure into a second fluid conveying structure without passing through any intervening fluid conveying structures. For example, direct fluid communication may be provided when a fluid passes through or over a boundary formed between the two fluid conveying structures, such as when passing through an opening formed in one of the fluid conveying structures.

In contrast, references to indirect fluid communication between two fluid conveying structures indicates that the fluid passes through at least a third intervening fluid conveying structure when passing from the first fluid conveying structure to the second fluid conveying structure. For example, the fluid may pass through a connecting pipe or conduit disposed between the first fluid conveying structure and the second fluid conveying structure, wherein the connecting pipe or conduit may be referred to as providing the indirect fluid communication between the first and second fluid conveying structures.

Additionally, references to an intervening fluid conveying structure or a boundary between a first fluid conveying structure and a second fluid conveying structure providing fluid communication between the first and second fluid conveying structures indicates that the fluid is able to pass through the intervening fluid conveying structure or the boundary when passing between the first and second fluid conveying structures, as opposed to requiring an alternative flow path not including the intervening fluid conveying structure or the boundary between the first and second fluid conveying structures. Additionally, references to a third and intervening fluid conveying structure providing direct fluid communication between a first fluid conveying structure and a second fluid conveying structure indicates that the third and intervening fluid conveying structure is the only fluid conveying structure through which the fluid passes when traveling from the first fluid conveying structure to the second fluid conveying structure, hence additional intervening fluid conveying structures are not disposed between the third and intervening fluid conveying structure and either of the first fluid conveying structure or the second fluid conveying structure.

Figure 1:
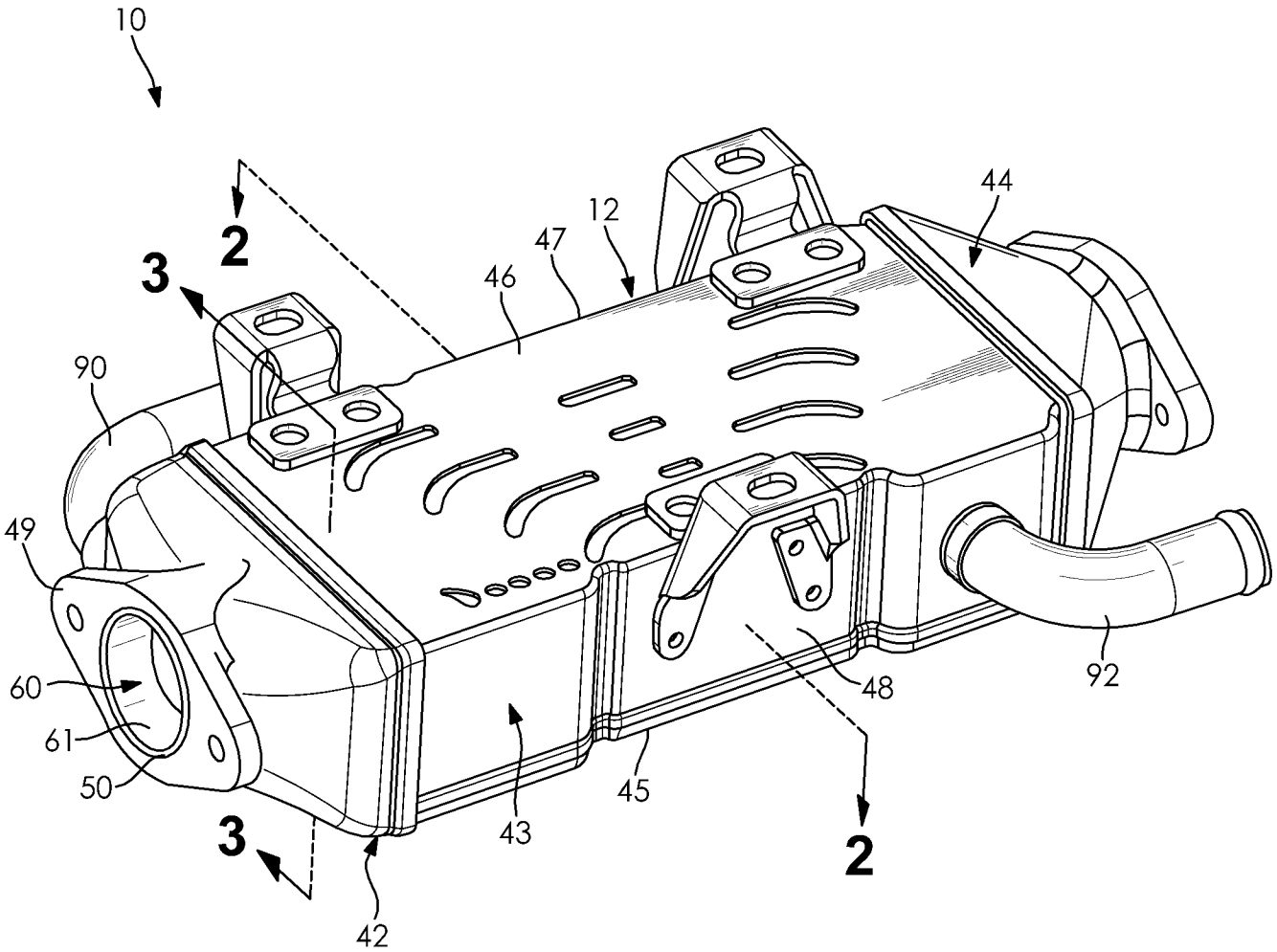
FIG. 1 is a perspective view of a heat exchanger accordingly to an embodiment of the present invention.
Figure 2:
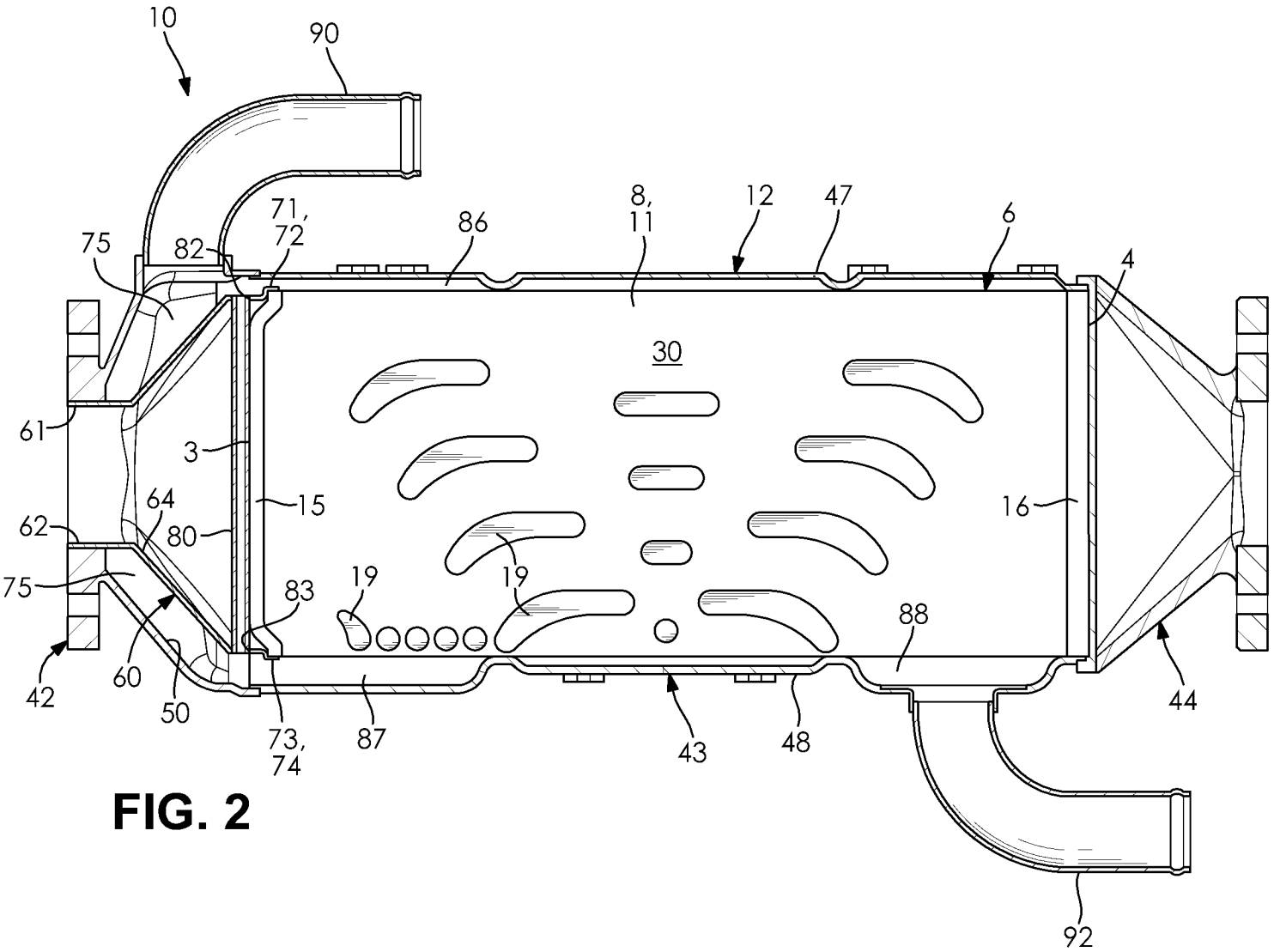
FIG. 2 is a cross-sectional top plan view of the heat exchanger as taken through section lines 2-2 of FIG. 1.
Figure 3:
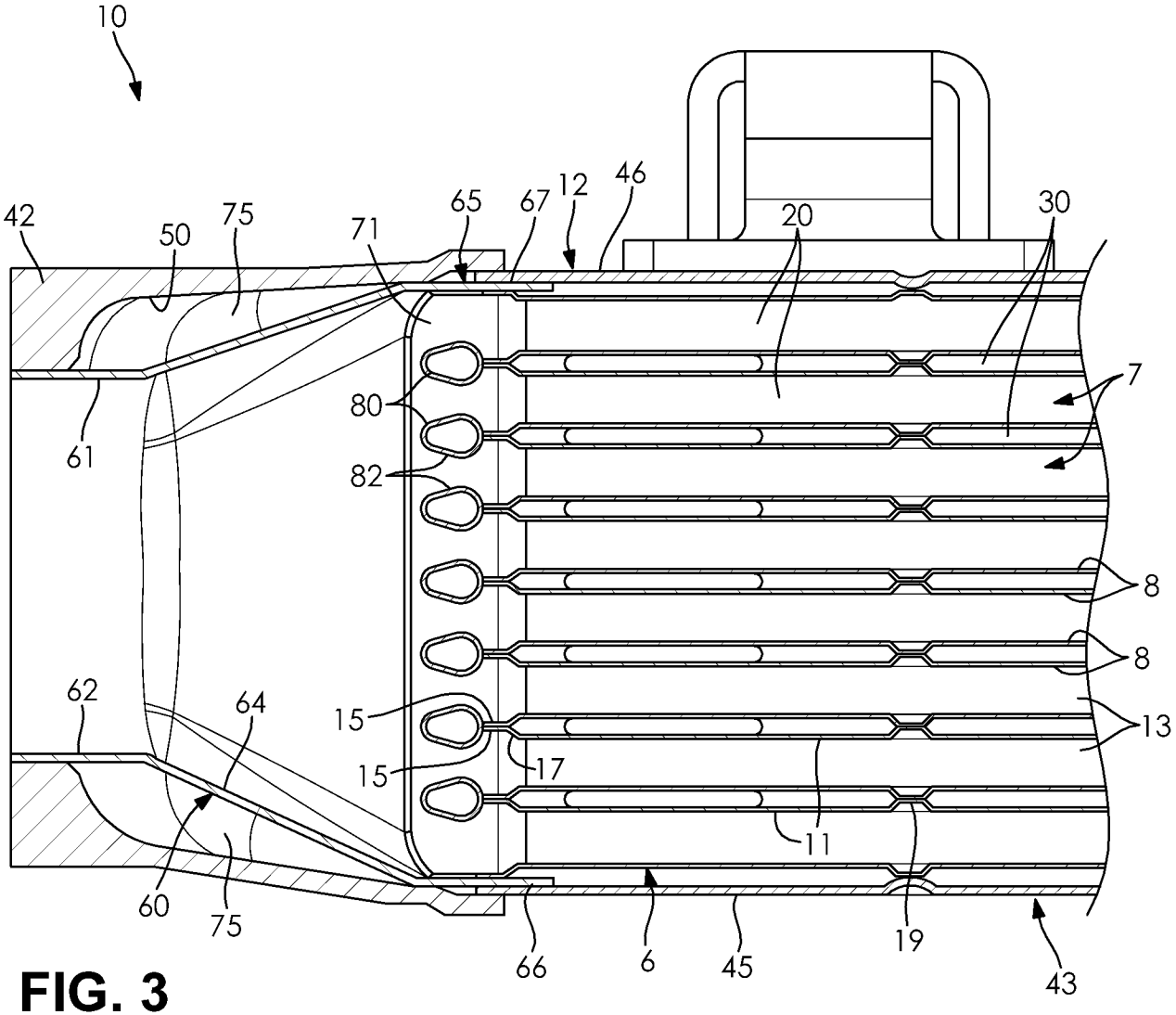
FIG. 3 is a fragmentary cross-sectional elevational view of the heat exchanger as taken through section lines 3-3 of FIG. 1.

FIGS. 1-3 illustrate a heat exchanger 10 according to an embodiment of the present invention. The heat exchanger is configured for exchanging energy between a first fluid and a second fluid, wherein the first fluid may be a high temperature gas such as the exhaust gases exiting an internal combustion engine of a motor vehicle while the second fluid may be a liquid coolant such as water, glycol, or combinations thereof. The exhaust gases may be passed through the heat exchanger 10 prior to being recirculated through the internal combustion engine in order to increase the density of the exhaust gases entering the internal combustion engine, which in turn improves the efficiency of the internal combustion engine. The heat exchanger 10 may accordingly be referred to as an exhaust gas recirculation (EGR) cooler, as desired. As such, it is hereinafter assumed that the first fluid is provided as the exhaust gases of the internal combustion engine while the second fluid is provided as any type of coolant having a lower temperature than the exhaust gases. However, one skilled in the art will appreciate that the concepts disclosed herein may be adapted for use in any heat exchanger configured for exchanging heat between any two heat exchanging fluids, as desired, and especially in situations when the fluid in need of cooling is relatively high in temperature in a manner potentially affecting the thermal expansion and hence structural stability of the components forming the heat exchanger 10. For example, the exhaust gases suitable for passage through the heat exchanger 10 of the present disclosure may include a maximum temperature in the range of 950° C., wherein such high temperature exhaust gases can have significant impacts on the thermal expansion of the materials considered suitable for forming the heat exchanger 10.

The heat exchanger 10 includes a housing 12 encapsulating a heat exchanger core 6 and a precooling flow structure 60. The housing 12, the heat exchanger core 6, and the precooling flow structure 60 may all be formed from metallic materials suitable for joining to each other in a metal joining process such as welding, soldering, brazing, or other suitable joining processes, as non-limiting examples. The metallic materials may also be selected to include beneficial properties for interacting with the heat exchanging fluids passing through the heat exchanger 10, such as including a relatively high heat resistance, a relatively low thermal expansion coefficient, a relatively high thermal conductivity, and a relatively high corrosion resistance, as non-limiting characteristics. The metallic materials may be aluminum, steel, or alloys thereof, such as a stainless steel alloy, as one non-limiting example. One skilled in the art will appreciate that a variety of different materials may be suitable for forming the heat exchanger 10 as disclosed herein, and that such materials may include all or only some of the characteristics listed hereinabove depending on the specific application of the heat exchanger 10.

The heat exchanger core 6 is formed by a plurality of heat exchanger tubes 7 stacked in a height direction of the heat exchanger 10 arranged perpendicular to the longitudinal and width directions thereof. Each of the heat exchanger tubes 7 is provided as a substantially tubular structure having an interior configured for conveying the exhaust gases therethrough and an exterior configured for exposure to the coolant, wherein the heat exchange between the exhaust gases and the coolant occurs through each of the walls of each of the heat exchanger tubes 7 forming the division between the heat exchanging fluids. More specifically, the heat exchanger tubes 7 are arranged in a manner forming an alternating pattern of exhaust gas flow openings 20 and coolant flow openings 30 within the heat exchanger core 6 with respect to the aforementioned height (stacking) direction, wherein the exhaust gas flow openings 20 are configured to convey a flow of the exhaust gases therethrough while the coolant flow openings 30 are configured to convey a flow of the coolant therethrough.

In the present embodiment, each of the heat exchanger tubes 7 is formed by the cooperation of two opposing and substantially structurally similar heat exchanger elements 8. Each of the heat exchanger elements 8 may be substantially plate-like in configuration with a substantially planar central portion 11 comprising the majority of the exposed surface area of each of the heat exchanger elements 8. Each of the central portions 11 is formed by a wall extending primarily in the longitudinal and width directions of the heat exchanger core 6. The central portions 11 of adjacent ones of the heat exchanger elements 8 are spaced from each other in the height direction of the heat exchanger 10 in order to form the aforementioned alternating pattern of the exhaust gas flow openings 20 and the coolant flow openings 30. This alternating pattern results in an inner surface of each of the central portions 11 being exposed to the exhaust gases being conveyed through the interior of the heat exchanger tubes 7 and the outer surface of each of the central portions 11 being exposed to the coolant passing between adjacent ones of the heat exchanger tubes 7.

Each of the longitudinally extending lateral sides of the central portion 11 of each of the heat exchanger elements 8 may include a lateral side wall 13 projecting therefrom (FIG. 3) in the height direction towards the central portion 11 of the other of the heat exchanger elements 8 forming the corresponding heat exchanger tube 7. Each of the lateral side walls 13 of one of the heat exchanger elements 8 may in turn be coupled to a corresponding lateral side wall 13 of the another of the heat exchanger elements 8 to form the aforementioned closed tubular shape around a periphery of each of the heat exchanger tubes 7 in a fluid tight manner in order to prevent mixing between the exhaust gases and the coolant. In some embodiments, the lateral side walls 13 may be joined at a seam (not shown) where the lateral side walls 13 meet whereas in other embodiments the lateral side walls 13 may be overlapped with each other with respect to the height direction in order to increase the surface area of the joint formed between the engaging lateral side walls 13 for forming a robust connection between the heat exchanger elements 8. One skilled in the art should appreciate that any configuration of the central portion 11 and the corresponding lateral side walls 13 may be utilized without departing from the scope of the present invention so long as the described fluid tight tubular shape is established for conveying the exhaust gases and the coolant throughout the heat exchanger core 6 in the manner described herein.

Each of the heat exchanger elements 8 further includes a first end coupling portion 15 disposed at a first end 3 of the heat exchanger core 6 as well as a second end coupling portion 16 disposed at an opposing second end 4 of the heat exchanger core 6, wherein the first end 3 of the heat exchanger core 6 corresponds to an inlet end thereof with respect to the flow of the exhaust gases therethrough while the second end 4 of the heat exchanger core 6 corresponds to an outlet end thereof with respect to the flow of the exhaust gases therethrough. The first and second end coupling portions 15, 16 of each of the heat exchanger elements 8 are each arranged on a plane arranged substantially parallel to the plane of the central portion 11 of the corresponding heat exchanger element 8 while spaced apart outwardly therefrom with respect to the height direction of the heat exchanger 10. A first bent portion 17 connects each of the central portions 11 to the corresponding first end coupling portion 15 adjacent the inlet end 3 of the heat exchanger core 6 while a second bent portion (not shown) connects each of the central portions 11 to the corresponding second end coupling portion 16 adjacent the outlet end 4 of the heat exchanger core 6, wherein the first and second bent portions each extend at least partially in the height direction of the heat exchanger 10 to displace the first and second coupling portions 15, 16 from the plane of the central portion 11. The outward spacing of each of the end coupling portions 15, 16 from the plane of the central portion 11 results in each of the heat exchanger tubes 7 having an enlarged cross-section with respect to the height direction at each of the ends 3, 4 of the heat exchanger core 6. This outward spacing of the end coupling portions 15, 16 relative to the corresponding central portions 11 also forms the spaces between the central portions 11 associated with two adjacent ones of the heat exchanger tubes 7 for forming the aforementioned coolant flow openings 30.

As best shown in FIG. 2, the first end coupling portion 15 of each of the heat exchanger elements 8 may be indented inwardly with respect to the longitudinal direction of the heat exchanger 10 at each of the lateral sides of the heat exchanger element 8. This inward indenting of the lateral regions of each of the first end coupling portions 15 may be provided to facilitate a coupling of the precooling flow structure 60 to an outer perimeter of the heat exchanger core 6, as desired. The indenting of the lateral regions of each of the first end coupling portion 15 also allows for the remainder of each of the first end coupling portions 15 to project at least partially into an interior of the precooling flow structure 60, as explained in greater detail hereinafter.

An outer surface of each of the end coupling portions 15, 16 is coupled to the outer surface of another of the end coupling portions 15, 16 at each longitudinal end 3, 4 of the heat exchanger core 6. The end coupling portions 15, 16 may be coupled to each other by any method suitable for forming a fluid tight seal, including metal joining processes such as welding, soldering, brazing, or other suitable joining processes, as non-limiting examples. The first end 3 of the heat exchanger core 6 accordingly includes a plurality of joints formed between adjacent ones of the heat exchanger tubes 7 with each of the joints formed where the first end coupling portion 15 of one of the heat exchanger elements 8 is directly coupled to the first end coupling portion 15 of an adjacent one of the heat exchanger elements 8.

The above described configuration of the stack of the heat exchanger tubes 7 results in the first end 3 of the heat exchanger core 6 being comprised of a plurality of voids forming the exhaust gas flow openings 20 that are interposed between the joined together first end coupling portions 15 of adjacent ones of the heat exchanger tubes 7. Each of the exhaust gas flow openings 20 may accordingly include a substantially rectangular or rounded rectangular cross-sectional shape that is partially bounded by one of the pairs of the joined together first end portions 15 at each of two opposing sides of the cross-sectional shape. Additionally, the entirety of the first end 3 of the heat exchanger core 6 may include a rectangular or rounded rectangular perimeter shape formed by the cooperation of each of the similarly shaped heat exchanger tubes 7, wherein this perimeter shape is provided for coupling the first end 3 of the heat exchanger core 6 to a perimeter of the precooling flow structure 60.

In some embodiments, the central portion 11 of each of the heat exchanger elements 8 may further include projections, ribs, grooves, depressions, or the like suitable for introducing turbulence into one or both of the heat exchanging fluids passing through the heat exchanger core 6 or for increasing an exposed surface area of the heat exchanger core 6 utilized for facilitating the heat transfer between the heat exchanging fluids. Additionally, independently provided structures such as fins or the like may also be disposed in the exhaust gas flow openings 20 or the coolant flow openings 30 for further adding turbulence to the associated fluids or for further increasing the exposed heat exchanging surfaces of the heat exchanger core 6. Such fins (not shown) may be provided as wavy or corrugated walls extending between the central portions 11 of two adjacent ones of the heat exchanger elements 8, as desired.

The outer surface of each of the central portions 11 may further include flow directing features 19 for prescribing a desired flow pattern of the coolant when flowing through the coolant flow openings 30 formed between adjacent ones of the heat exchanger tubes 7. The flow directing features 19 may be provided as projections, corrugations, ribs, or independently provided structures, as desired. As shown in FIG. 2, the illustrated embodiment includes a plurality of the flow directing features 19 with a shape and a positioning of the flow directing features 19 tending to cause any coolant introduced into the coolant flow openings 30 to first flow along the first end 3 of the heat exchanger core 6 before curving arcuately towards the oppositely arranged second end 4 of the heat exchanger core 6. However, one skilled in the art should appreciate that any pattern and configuration of the flow directing features 19 may be utilized for prescribing the flow of the coolant without departing from the scope of the present invention.

The heat exchanger core 6 may be substantially similar in structure to any of the heat exchanger cores of any of the EGR coolers as disclosed in pending U.S. Pat. Appl. Pub. No. 2017/0152816 to Ohrem et al., which is hereby incorporated herein by reference in its entirety. It should also be apparent to one skilled in the art that any heat exchanger core 6 having a suitable perimeter shape as well as an inlet arrangement including an alternating pattern of flow openings and joined dividers for separating the flow openings may be utilized without necessarily departing from the scope of the present invention, as desired. For example, the heat exchanger tubes 7 may be formed by any manufacturing method or may include any number of joined together segments so long as the resulting heat exchanger tubes 7 are stacked and joined to each other in a manner forming the alternating pattern of the flow openings and the joints formed between adjacent ones of the heat exchanger tubes 7.

The housing 12 may be comprised of an inlet housing 42, a core housing 43, and an outlet housing 44. The inlet housing 42 is coupled to one longitudinal end of the core housing 43 while the outlet housing 44 is coupled to an opposing end of the core housing 43. The core housing 43 is open at each longitudinal end thereof and generally defines a bottom wall 45, an oppositely arranged top wall 46, a first lateral wall 47, and an oppositely arranged second lateral wall 48. The core housing 43 may be formed from any combination of segments or shells cooperating to form a closed shape for surrounding the heat exchanger core 6. For example, in some embodiments the bottom wall 45 may form one segment of the core housing 44 while the remaining walls 46, 47, 48 are formed by a U-shaped component joined to each lateral side of the bottom wall 45, as desired. Alternatively, each of the walls 45, 46, 47, 48 may be formed independently before being coupled together to form the disclosed shape, as desired. The different portions of the housing 12 may be coupled to each other using any method suitable for forming a fluid tight seal, including metal joining processes such as welding, soldering, brazing, or other suitable joining processes, as non-limiting examples.

The inlet housing 42 defines an opening 50 that transitions from a cylindrical portion having a circular cross-section at an upstream end of the inlet housing 42 to a rectangular pyramidal portion having a substantially rectangular or rounded-rectangular cross-section at a downstream end of the inlet housing 42 configured to engage a longitudinal end of the core housing 43. The cylindrical portion of the opening 50 may be formed in a flanged portion 49 of the inlet housing 42 configured for coupling the inlet housing 42 to an adjacent and upstream arranged component or conduit conveying the exhaust gases to the heat exchanger 10. The opening 50 is enlarged in cross-section within the outwardly tapering rectangular pyramidal portion of the inlet housing 42 as the opening 50 extends towards the first end 3 of the heat exchanger core 6.

The precooling flow structure 60 is a thin walled conduit defining a flow opening 61 therethrough and includes a shape and configuration that is substantially similar to that of the inlet housing 42. The precooling flow structure 60 includes a cylindrical portion 62 at one end thereof and an outwardly tapered rectangular pyramidal portion 64 extending away from the cylindrical portion 62, wherein a transition from the cylindrical portion 62 to the rectangular pyramidal portion 64 occurs in the absence of sharp corners or changes in direction to prevent an undesired pressure drop in the exhaust gases or the coolant that may encounter the precooling flow structure 60. The rectangular pyramidal portion 64 tapers outwardly to a rim 65 configured to engage the heat exchanger core 6 about a perimeter thereof at the first end 3 of the heat exchanger core 6. As shown in FIG. 3, a first wall 66 forming a bottom portion of the rim 65 is received between a bottom surface of the heat exchanger core 6 and a top surface of the bottom wall 45 of the core housing 43 while an oppositely arranged second wall 67 forming a top portion of the rim 65 is received between a top surface of the heat exchanger core 6 and a bottom surface of the top wall 46 of the core housing 43. As best shown in FIG. 2, a third wall 71 forming a first lateral side of the rim 65 includes a first bent coupling portion 72 extending over and contacting a first lateral side of the heat exchanger core 6 (as formed by the lateral sidewalls 13 of the heat exchanger elements 8) while a fourth wall 73 forming a second lateral side of the rim 65 includes a second bent coupling portion 74 extending over and contacting a second lateral side of the heat exchanger core 6.

A fluid tight seal may be formed at the joint present between the cylindrical portion 62 of the precooling flow structure 60 and the circular cross-sectioned portion of the inlet housing 42 via a metal joining process such as welding, soldering, brazing, or other suitable joining processes, as desired. The rim 65 of the precooling flow structure 60 may also be coupled to the heat exchanger core 6 to form a flight tight seal at the joint present therebetween by any metal joining process such as welding, soldering, brazing, or other suitable joining processes, as desired. The flight tight sealing of the precooling flow structure 60 at each end thereof allows for the precooling flow structure 60 to act as a manifold for distributing the exhaust gases to each of the heat exchanger tubes 7 forming the heat exchanger core 6.

The precooling flow structure 60 further includes a plurality of precooling tubes 80 extending between the third wall 71 and the fourth wall 73 thereof. The third wall 71 includes a plurality of first tube openings 82 spaced apart from each other in the height direction of the heat exchanger 10 and the fourth wall 73 similarly includes a plurality of second tube openings 83 also spaced from each other in the height direction of the heat exchanger 10, wherein each of the first tube openings 82 corresponds to and opposes one of the second tube openings 83. A first end of each of the precooling tubes 80 is received within one of the first tube openings 82 while a second end of each of the precooling tubes 80 is received within one of the second tube openings 83. An outer surface of each of the ends of each of the precooling tubes 80 is coupled to each corresponding surface of the precooling flow structure 60 defining one of the tube openings 82, 83 by means of a suitable metal joining process such as welding, soldering, brazing, or other suitable joining process, as non-limiting examples. A fluid tight seal is accordingly established about a perimeter of each of the precooling tubes 80 for preventing mixing between the exhaust gases and the coolant at each of the tube openings 82, 83.

Figure 4:
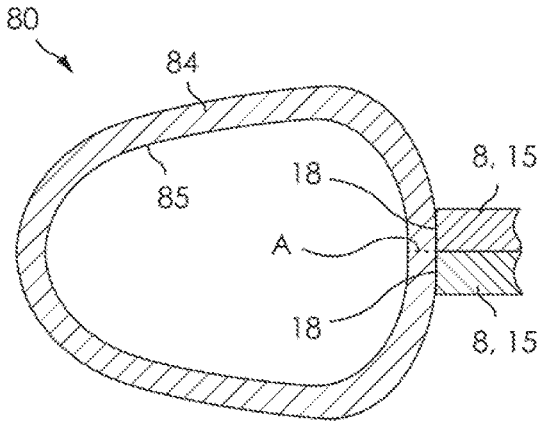
FIG. 4 is an enlarged fragmentary cross-sectional elevational view showing an interface between a precooling tube and a pair of heat exchanger elements of the heat exchanger of FIGS. 1-3, wherein the precooling tube has a substantially egg-shaped cross-section.

FIG. 4 illustrates an enlarged fragmentary view of one of the precooling tubes 80 of FIG. 3 relative to the first end coupling portions 15 of two adjacent and coupled together heat exchanger elements 8 forming portions of two adjacent heat exchanger tubes 7. The precooling tube 80 is shown as including a wall 84 having an inner surface defining a flow opening 85 for receiving the coolant and an outer surface that is coupled to the joined together first end coupling portions 15. More specifically, the outer surface of the wall 84 is coupled to an end surface 18 of each of the first end coupling portions 15 with the wall 84 extending across the joint formed between the engaging surfaces of the pair of the first end coupling portions 15. The coupling may be accomplished by any metal joining process including welding, soldering, brazing, or other suitable jointing processes, as desired. As mentioned previously, the first end coupling portions 15 may project longitudinally beyond structures such as the lateral sidewalls 13 and towards the interior of the precooling flow structure 60 to establish the joint between the outer surface of the wall 84 of each of the precooling tubes 80 and the end surfaces 18 of the adjoining first end coupling portions 15 while maintaining the peripheral connection between the rim 65 of the precooling flow structure 60 and the heat exchanger core 6, as desired.

The wall 84 is shown in FIG. 4 as including a substantially egg-shaped cross-section including a narrow rounded end facing towards the flow of the exhaust gases when entering the exhaust gas flow openings 20 and an enlarged rounded end facing away from the flow of the exhaust gases and towards the end surfaces 18 of the first end coupling portions 15. The narrow rounded end may preferably be facing towards the exhaust gases in order to prevent an undesired pressure drop in the exhaust gases when first encountering the precooling tubes 80. The narrow end being disposed towards the flow of the exhaust gases also prevents an undesired flow restriction of the exhaust gases which may negatively affect the flow rate of the exhaust gases through the heat exchanger 10.

The closed shape formed by the wall 84 may be accomplished via a manufacturing process such as extrusion molding, as one non-limiting example. However, any manufacturing process capable of forming the closed perimeter shape of the wall 84 while forming the flow opening 85 therein may be employed without departing from the scope of the present invention, as desired. The use of such a closed shape eliminates one joint in need of fluid tight sealing for preventing the mixing of the exhaust gases with the coolant at the interface between the precooling tubes 80 and the heat exchanger elements 8. However, the wall 84 may alternatively be formed by bending or otherwise deforming a sheet of material into the desired cross-sectional shape before subsequently coupling the wall 84 to the end surfaces 18 of the first end coupling portions 15 in similar fashion to that shown in FIG. 4. For example, FIG. 4 includes a dashed line A corresponding to a desired location of the seam between the opposing ends of such a sheet if the wall 84 is instead formed in this manner. The seam is shown as being formed on the end of the precooling tube 80 facing towards the first end coupling portions 15 in order to protect the seam from undesired exposure to the high temperature exhaust gases while entering the heat exchanger core 6.

Figure 5:
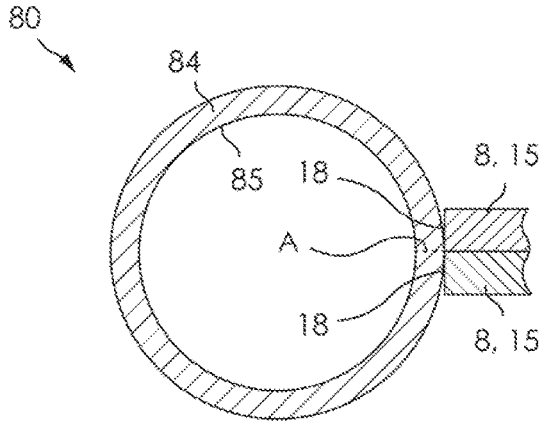
FIG. 5 is an enlarged fragmentary cross-sectional elevational view showing an interface between a precooling tube and a pair of heat exchanger elements of the heat exchanger according to another embodiment of the invention, wherein the precooling tube has a substantially circular cross-section.
Figure 6:
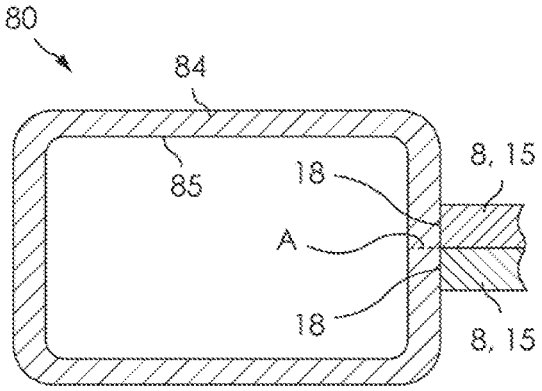
FIG. 6 is an enlarged fragmentary cross-sectional elevational view showing an interface between a precooling tube and a pair of heat exchanger elements of the heat exchanger according to another embodiment of the invention, wherein the precooling tube has a substantially rectangular cross-section.
Figure 7:
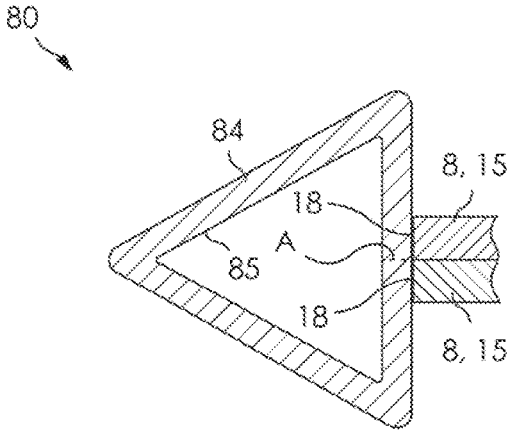
FIG. 7 is an enlarged fragmentary cross-sectional elevational view showing an interface between a precooling tube and a pair of heat exchanger elements of the heat exchanger according to another embodiment of the invention, wherein the precooling tube has a substantially triangular cross-section.

FIGS. 5-7 illustrate various other potential cross-sectional shapes of the precooling tubes 80 that may be suitable for use with the heat exchanger 10, wherein each of the disclosed embodiments includes substantially the same general configuration as is disclosed with reference to FIG. 4. More specifically, FIG. 5 illustrates the precooling tube 80 as having a substantially circular (elliptical) cross-section, FIG. 6 illustrates the precooling tube 80 as having a substantially rectangular cross-section, and FIG. 7 illustrates the precooling tube 80 as having a substantially triangular cross-section. In each case, the outer surface of the wall 84 forming each of the described cross-sectional shapes is once again coupled to the joined together pair of the first end coupling portions 15 across the joint therebetween to protect the joint from direct exposure to the high temperature exhaust gases when entering the heat exchanger core 6. Additionally, it is worth noting that the embodiments shown in FIGS. 5 and 7 once again include the inwardly tapering surfaces of each of the cross-sectional shapes facing towards the oncoming flow of the exhaust gases in order to prevent the undesired pressure drop and flow restriction mentioned hereinabove. Each of the embodiments disclosed throughout FIGS. 5-7 also includes the identification of the seam A at which a sheet of material would have to be joined in order to form each of the cross-sectional shapes while once again protecting the seam from direct exposure to the flow of the exhaust gases.

Figure 8:
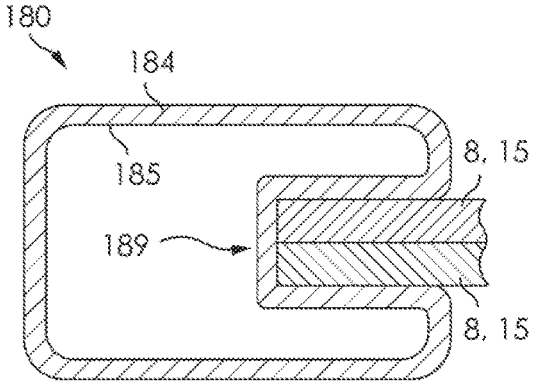
FIG. 8 is an enlarged fragmentary cross-sectional elevational view showing an interface between a precooling tube and a pair of heat exchanger elements of the heat exchanger according to another embodiment of the invention, wherein the precooling tube has a substantially rectangular cross-section with an indented portion configured to receive the ends of the pair of the heat exchanger elements therein.

FIG. 8 illustrates a precooling tube 180 having a modified configuration in comparison to the precooling tubes 80 of FIGS. 4-7. The precooling tube 180 includes a wall 184 having a substantially rectangular cross-sectional shape in similar fashion to the wall 84 of the precooling tube 80 illustrated in FIG. 6, but the wall 184 further includes an inwardly extending indented portion 189 configured to receive the pair of the joined together first end coupling portions 15 therein. The inclusion of the indented portion 189 allows for the wall 184 of the precooling tube 180 to wrap around three different surfaces of the joined together first end coupling portions 15 to improve the robustness of the coupling therebetween. Additionally, the wall 184 includes a greater surface area in contact with the heat exchanger elements 8 for promoting increased heat transfer between the coolant conveyed through a flow opening 185 of the precooling tube 180 and the engaging heat exchanger elements 8. The manner in which the wall 184 wraps around the joined together first end coupling portions 15 further protects the joint formed between the first end coupling portions 15 from exposure to the high temperature exhaust gases. An indented portion such as is disclosed in FIG. 8 may also be introduced into any of the cross-sectional shapes illustrated throughout FIGS. 4-7 without departing from the scope of the present invention.

Figure 9:
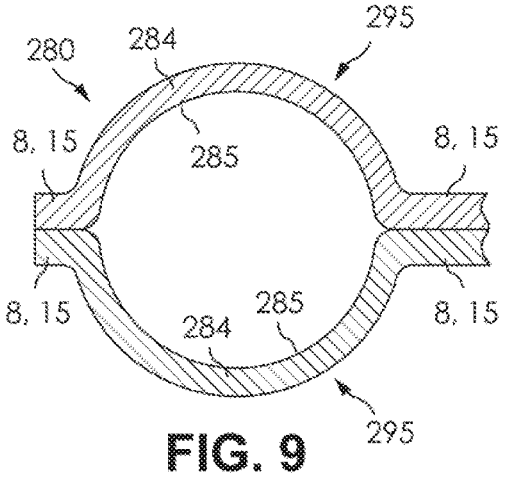
FIG. 9 is an enlarged fragmentary cross-sectional elevational view showing a precooling tube according to another embodiment of the invention, wherein the precooling tube is formed by the cooperation of two adjoining heat exchanger elements that are indented inwardly relative to an interior of two adjacent ones of the heat exchanger tubes.

Lastly, FIG. 9 illustrates yet another precooling tube 280 according to another embodiment of the present invention. The precooling tube 280 is formed by the cooperation of the first end coupling portions 15 of two adjacent and coupled together heat exchanger elements 8 forming portions of two adjacent heat exchanger tubes 7. Specifically, each of the end coupling portions 15 includes an indented portion 295 that is indented inwardly relative to the interior of each of the adjacent heat exchanger tubes 7 formed partially by one of the heat exchanger elements 8. What would otherwise be provided as an outer surface of each of the adjacent heat exchanger tubes 7 accordingly forms an inner surface of a flow opening 285 formed through the precooling tube 280. A wall 284 defining each of the indented portions 295 and hence a portion of each of the flow openings 285 is accordingly formed by an extension of one of the heat exchanger elements 8. The end coupling portion 15 of each of the heat exchanger elements 8 is therefore coupled to the end coupling portion 15 of the adjoining one of the heat exchanger elements 8 at two longitudinally spaced positions straddling the indented portions 295 to form each of the flow openings 285. The configuration shown in FIG. 9 accordingly includes each of the precooling tubes 280 formed at least partially by a pair of the heat exchanger elements 8 rather than being provided as a separately formed and subsequently joined structure as is disclosed with reference to FIGS. 4-8. The third wall 71 and the fourth wall 73 defining opposing lateral sides of the precooling flow structure 60 accordingly include tube openings 82, 83 accommodating the precooling tubes 280 formed by the cooperation of portions of two adjacent ones of the heat exchanger tubes 7. It should be apparent to one skilled in the art that each of the shapes disclosed in FIGS. 4, 6, and 7 may be replicated to form one of the precooling tubes 280 without departing from the scope of the present invention.

Although the precooling tubes 80, 180 are described as being coupled to the heat exchanger elements 8 or formed by a portion of each of the heat exchanger elements 8, it should be apparent to one skilled in the art that the precooling tubes 80, 180 may still offer a beneficial cooling effect if disposed at any position upstream of the heat exchanger core 6 so long as the precooling is sufficient to prevent the exposure of the heat exchanger core 6 to undesirable temperatures. However, such a lack of direct contact between the precooling tubes 80, 180 and the heat exchanger core 6 may undesirably fail to offer the protection of the corresponding joints from direct exposure to the exhaust gases in the manner described hereinabove.

The size, cross-sectional shape, and wall thickness of each of the disclosed precooling tubes 80, 180, 280 may be selected to give each of the precooling tubes 80, 180, 280 a desired heat exchange capacity for the given conditions of the two fluids exchanging heat within the heat exchanger 10. The shape of the cross-section of the precooling tubes 80, 180, 280 may be elongated or shortened in either of the longitudinal direction or the height direction in order to alter the cross-sectional flow area of the corresponding precooling tube 80, 180, 280 in comparison to the exposed surface area of the corresponding precooling tube 80, 180, 280. The shape and dimensions of each of the precooling tubes 80, 180, 280 may also be selected in order to prescribe a desired pressure drop and flow restriction with respect to the exhaust gases, as desired.

Referring back to FIGS. 1-3, a precooling chamber 75 is formed between an inner surface of the inlet housing 42 defining the pyramidal shaped portion of the opening 50 and an outer surface of the precooling flow structure 60 defining the pyramidal portion 64 thereof. A coolant inlet conduit 90 intersects one of the sidewalls of the inlet housing 42 and conveys the coolant to the precooling chamber 75. The precooling chamber 75 includes an upstream side fluidly coupled to a first manifold chamber 86 formed between a first lateral side of the heat exchanger core 6 and the first lateral wall 47 of the core housing 43 as well as a downstream side fluidly coupled to a second manifold chamber 87 formed between a second lateral side of the heat exchanger core 6 and the second lateral wall 48 of the core housing 43. Each of the manifold chambers 86, 87 extends in the height direction of the heat exchanger 10 and provides fluid communication between the precooling chamber 75 and each of the coolant flow openings 30 formed between adjacent ones of the heat exchanger tubes 7 forming the heat exchanger core 6.

In use, relatively hot exhaust gases are conveyed through the flow opening 61 of the precooling flow structure 60 before encountering and flowing between adjacent ones of the precooling tubes 80 when the exhaust gases are distributed to the spaced apart exhaust gas flow openings 20. Simultaneously, relatively cool coolant is introduced into the housing 12 through the coolant inlet conduit 90. The coolant enters the precooling chamber 75 before being subsequently distributed to an inlet end of each of the precooling tubes 80 as well as the first manifold chamber 86. The coolant within the precooling chamber 75 is distributed to each of the precooling tubes 80 while the coolant within the first manifold chamber 86 is distributed to each of the coolant flow openings 30. The coolant flows around the precooling flow structure 60, through the precooling tubes 80, and through the coolant flow openings 30 while exchanging heat with the exhaust gases flowing through each subsequent portion of the heat exchanger 10 while flowing in the longitudinal direction thereof. The coolant flowing through the precooling tubes 80 is recombined within the second manifold chamber 87 after exchanging heat with the exhaust gases and is then distributed to each of the coolant flow openings 30 at a side of the heat exchanger core 6 opposite the first manifold chamber 86. As prescribed by the flow directing features 19, the coolant flows adjacent the first end 3 of the heat exchanger core 6 when first distributed by the opposing manifold chambers 86, 87 before curving arcuately towards the second end 4 of the heat exchanger core 6 where the coolant is recombined within a third manifold chamber 88 formed between the heat exchanger core 6 and the core housing 43. The coolant then flow from the third manifold chamber 88 towards an outlet conduit 92 fluidly coupled to the core housing 43 and configured to convey the coolant away from the heat exchanger 10. The exhaust gases continue to pass through the heat exchanger 10 while flowing in the longitudinal direction thereof until the exhaust gases exit the heat exchanger 10 through the outlet housing 44 thereof.

The precooling flow structure 60 provides numerous advantages in that the coolant can exchange heat with the exhaust gases within the inlet housing 42 and prior to entering the heat exchanger core 6. Specifically, the coolant exchanges heat with the exhaust gases through each of the wall of the precooling flow structure 60 separating the two fluids as well as the precooling tubes 80 extending between opposing lateral sides of the precooling flow structure 60. The exhaust gases are accordingly precooled prior to entering the heat exchanger core 6 of the heat exchanger 10. It has been discovered that this precooling of the exhaust gases tends to reduce the temperature of the exhaust gases sufficiently to prevent the occurrence of high magnitude stresses and strains within various portions of the heat exchanger 10, and especially those components forming the first end 3 of the heat exchanger core 6 such as the joined together first end coupling portions 15. The precooling of the exhaust gases accordingly improves the life span of the heat exchanger 10 when exposed to thermal cycle loading. Further, the introduction of additional heat exchanging surfaces further improves the overall heat exchange capacity of the heat exchanger 10 regardless of the need for precooling of an especially hot fluid such as the exhaust gases.

The positioning of the precooling tubes 80 also aids in shielding the joints formed between the first end coupling portions 15 from being exposed directly to the flow of the exhaust gases. Additionally, the expanding geometry of the precooling flow structure 60 also advantageously allows for the majority of the flow of the exhaust gases to encounter the precooling tubes 80 within a portion of the heat exchanger core 6 in axial alignment with the cylindrical portion 62 of the precooling flow structure 60 due to the initial velocity of the exhaust gases when entering the heat exchanger 10, as opposed to allowing the highest temperature exhaust gases to directly encounter each joint formed between one of the precooling tubes 80 and a surface defining one of the tube openings 82, 83. The presence of the precooling chamber 75 having the coolant therein also provides heat exchange adjacent the tube openings 82, 83 for further reducing the temperature of the exhaust gases before encountering such joints. Lastly, the configuration of the precooling chamber 75 further provides a flow path for distributing the coolant to the coolant flow openings 30 at various locations about the heat exchanger core 6 by virtue of the manner in which the precooling chamber 75 encircles the precooling flow structure 60 at the inlet end of the heat exchanger 10.

While certain representative embodiments and details have been shown for purposes of illustrating the invention, it will be apparent to those skilled in the art that various changes may be made without departing from the scope of the disclosure, which is further described in the following appended claims.

What is claimed is:

1. A heat exchanger comprising:

a heat exchanger core configured for exchanging heat between a first fluid and a second fluid; and a precooling flow structure coupled to an inlet end of the heat exchanger core with respect to a direction of a flow of the first fluid, an interior of the precooling flow structure configured to convey the first fluid therethrough, the precooling flow structure including at least one precooling tube extending through the interior of the precooling flow structure, wherein the at least one precooling tube is configured to convey the second fluid therethrough in order to precool the first fluid before the first fluid enters the inlet end of the heat exchanger core, wherein the heat exchanger core is formed by a plurality of stacked heat exchanger elements, and the at least one precooling tube is upstream of an end of the heat exchange element with respect to the direction of the flow of the first fluid and directly coupled to an end of one of the heat exchanger elements, and wherein an end coupling portion is disposed at the end of the heat exchanger element, and the end coupling portion is indented inwardly with respect to a longitudinal direction of the heat exchanger at each of lateral sides of the heat exchanger element.

2. The heat exchanger of claim 1, further comprising a housing surrounding the heat exchanger core and the precooling flow structure.

3. The heat exchanger of claim 2, wherein the second fluid is conveyed through a precooling chamber formed between an inner surface of the housing and an outer surface of the precooling flow structure.

4. The heat exchanger of claim 3, wherein the second fluid is conveyed through a manifold chamber formed between the inner surface of the housing and an outer surface of the heat exchanger core.

5. The heat exchanger of claim 4, wherein the precooling chamber is in direct fluid communication with the manifold chamber.

6. The heat exchanger of claim 2, wherein an inlet end of the precooling flow structure is coupled to the housing and an outlet end of the precooling flow structure is coupled to the inlet end of the heat exchanger core with respect to the flow of the first fluid.

7. The heat exchanger of claim 1, wherein the heat exchanger core includes a plurality of exhaust gas flow openings configured to convey the first fluid therethrough and a plurality of coolant flow openings configured to convey the second fluid therethrough.

8. The heat exchanger of claim 7, wherein the interior of the precooling flow structure forms a manifold for distributing the first fluid to each of the plurality of the exhaust gas flow openings.

9. The heat exchanger of claim 8, wherein a housing surrounds the heat exchanger core and the precooling flow structure, wherein a precooling chamber formed between the housing and the heat exchanger core forms a manifold for distributing the second fluid to each of the plurality of the coolant flow openings.

10. The heat exchanger of claim 1, wherein the at least one precooling tube has one of an elliptical cross-sectional shape, an egg-shaped cross-sectional shape, a triangular cross-sectional shape, or a rectangular cross-sectional shape.

11. The heat exchanger of claim 1, wherein the first fluid is an exhaust gas after exiting an internal combustion engine of a motor vehicle and the second fluid is a coolant for cooling the exhaust gas.

12. A heat exchanger comprising:

a housing;

a heat exchanger core disposed within the housing and configured for exchanging heat between a first fluid and a second fluid; and a precooling flow structure disposed within the housing, the precooling flow structure coupled to each of the housing and an inlet end of the heat exchanger core with respect to a direction of the flow of the first fluid, an interior of the precooling flow structure configured to convey the first fluid therethrough, the precooling flow structure including at least one precooling tube extending through the interior of the precooling flow structure, wherein the at least one precooling tube is configured to convey the second fluid therethrough in order to precool the first fluid before the first fluid enters the inlet end of the heat exchanger core, wherein the heat exchanger core is formed by a plurality of stacked heat exchanger elements, and the at least one precooling tube is upstream of an end of the heat exchange element with respect to the direction of the flow of the first fluid and directly coupled to an end of one of the heat exchanger elements, and wherein an end coupling portion is disposed at the end of the heat exchanger element, and the end coupling portion is indented inwardly with respect to a longitudinal direction of the heat exchanger at each of lateral sides of the heat exchanger element.

13. The heat exchanger of claim 12, wherein the second fluid is conveyed through a precooling chamber formed between an inner surface of the housing and an outer surface of the precooling flow structure.

14. The heat exchanger of claim 12, wherein an inlet end of the precooling flow structure is coupled to the housing and an outlet end of the precooling flow structure is coupled to the inlet end of the heat exchanger core.

* * * * *